United States Patent [19]

Tsutsumino

[11] 4,084,420

[45] Apr. 18, 1978

[54] METHOD AND AN APPARATUS FOR PRODUCING A COILED SPRING

[75] Inventor: Takeyoshi Tsutsumino, Itamishi, Japan

[73] Assignee: Kabushiki Kaisha Taiheiseisakusho, Osakashi, Japan

[21] Appl. No.: 731,026

[22] Filed: Oct. 8, 1976

[30] Foreign Application Priority Data

Oct. 13, 1975 Japan ..... 50-123622

[51] Int. Cl.[2] ..... B21F 3/04

[52] U.S. Cl. ..... 72/138; 72/144

[58] Field of Search ..... 72/138, 142, 143, 144, 72/145; 140/92.2

[56] References Cited

FOREIGN PATENT DOCUMENTS

| | | | |
|---|---|---|---|
| 570,791 | 2/1959 | Canada | 72/138 |
| 852,998 | 11/1939 | France | 72/138 |
| 1,112,956 | 8/1961 | Germany | 72/144 |
| 268,685 | 4/1927 | United Kingdom | 72/144 |

*Primary Examiner*—E. M. Combs

*Attorney, Agent, or Firm*—Eyre, Mann, Lucas & Just

[57] ABSTRACT

The invention provides a method and an apparatus for automatic production of coiled springs, wherein the spring has close windings at both ends and rough windings with relatively large pitch in the middle portion, by shifting the supplying positions of a material wire in relation to a rotating fixed coil-supporter at varied speed in accordance with a desired winding pitch.

5 Claims, 3 Drawing Figures

METHOD AND AN APPARATUS FOR PRODUCING A COILED SPRING

The present invention relates to a method and an apparatus of producing a coiled spring having close winding at both ends. More particularly, the present invention relates to a method and an apparatus of producing such a coiled spring automatically.

So far a coiled spring has been produced substantially by hand because of the difficulty in winding a wire with different pitches at end portions and in the middle portion. At end portions the wire is closely wound, and in the middle portion it is spacedly wound with a relatively large pitch. This has made it difficult to achieve an automatic production of such type of coiled spring. In addition, the manual production requires a high degree of skill in securing equal winding pitches. Thus the known process results in an increased production cost, and also fails to secure the equal quality of the products.

The present invention aims at overcoming the difficulties mentioned above, and has for its object to provide an apparatus and a method of ensuring an automatic production of coiled springs having different pitches at end portions and in the middle portion.

The invention will be more particularly described by way example with reference to the drawing, in which.

Figure 1:
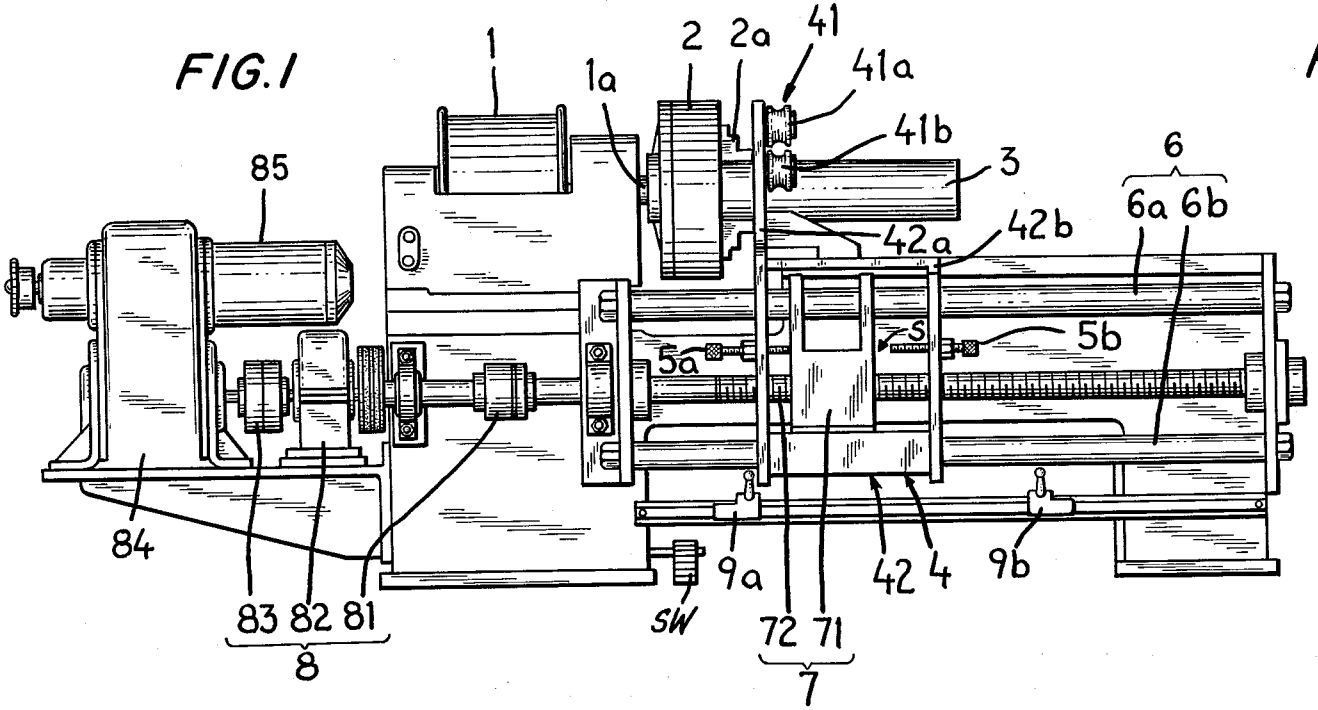
FIG. 1 is a front view of an apparatus according to the present invention.

Referring to FIG. 1 the apparatus includes a motor 1, prefereably a brakemotor, a spindle 1*a* driven by the motor, a chuck 2 fixed to the spindle, a rotating coil-supporter 3 rigid with the chuck, and a wire supply assembly 4 carried on a cross-slide 42, which substantially takes the form of a framwork 42*b*, having an arm 42*a* supporting a wire guide roll section 41 (consisting of a pair of guide rollers 41*a* and 41*b*). The cross-slide 42 is slidably supported on a pair of bars 6*a* and 6*b*, and within the framwork 42*b* there is provided a nut 71 carried on a threaded bar 72, wherein the movement of the nut is limited between bolts 5*a* and 5*b* supported in the framework 42*b*. When the nut 71 is caused to move to the right (in FIG. 1) in association with the rotation of the threaded bar 72, the nut comes into abutment with the bolt 5*b*, and pushes the framework 42*b*, that is, the cross-slide 42 along the guide bars 6*a* and 6*b*. There are provided switches 9*a* and 9*b* for regulating the movement of the cross-slide 42, and also for controlling the operation of the apparatus, which will be described in detail hereinafter.

The threaded bar 72 is driven by a motor 85 via a variable speed gear 84 and a power transmission section 8, which includes a clutch 81, a speed reducer 82 and a coupling 83. By employing the variable speed gear and the speed reducer the r.p.m. of the threaded bar, that is, the speed of the cross-slide 42 can be changed, thereby ensuring the production of different pitches of coil springs. The clutch 81, preferably a magnetic clutch, is deenergized when the switch 9*b* is actuated by the cross-slide 42, thereby disconnecting the threaded bar from the power transmission section 8. 'SW' indicates a pedal switch.

Figure 3:
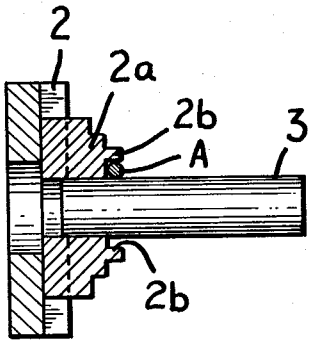
FIG. 3 is an explanatory view of the chuck portion.

As described above, the rotating coil supporter 3 is detachably supported on the chuck 2, wherein the supporter will be replaced variously in accordance with the desired diameter of a coil spring to be made. A material wire (A) is wound around the supporter 3, being supplied from the guide rollers 41*a* and 41*b*. In this case, the chuck pawl 2*a* is provided with a gap 2*b*, so as to receive the material wire (A) being kept in contact with the surface of the supporter 3, as illustrated in FIG. 3.

Figure 2:
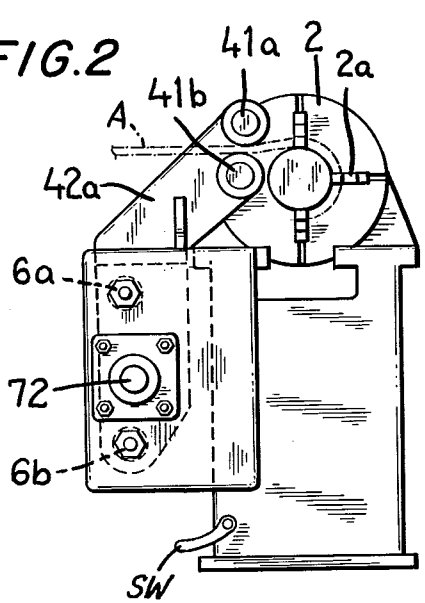
FIG. 2 is a side view of the apparatus in FIG. 1.

The relative positions of the coil-supporter 3 and the pair of guide rollers 41*a* and 41*b* are shown in FIG. 2, and the rollers are preferably grooved so as to enable the wire to rest thereon safely.

In FIG. 1 a gap between the bolt 5*b* and the nut 71 is indicated by letter S, which determines the amount of initial close winding of the forming sping.

A typical operation of the present invention will be explained.

The motor 85 is started with the clutch 81 in disengaement, and a material wire (A) is held in the wire guide roll section 41 with the tip portion thereof being inserted in the gap 2*b*. At this stage the cross-slide 42 and the nut 71 are situated at the left-hand positions (in FIG. 1), wherein the nut is in contact with the bolt 3*a*. Then the pedal switch 'SW' is turned on so as to start the motor 1, thereby rotating the coil-supporter 3. At the same time, the clutch 81 is connected, and the threaded bar 72 starts its rotation. The rotation of the threaded bar makes the nut move to the right, but it does not affect the winding of the wire around the coil-supporter 3 until the nut comes into abutment with the bolt 5*b*. On the other hand the wire (A) is supplied onto the coil-supporter 3 on which the wire is wound with an angle corresponding to the fixing angle of the guide rollers 41*a* and 41*b*. In this situation the wire is closely wound with no space therebetween, and as the winding advances the cross-slide 42 is caused to displace to the right. In this way the initial close winding is continued until the cross-slide 42 is pushed by the nut 71. After the cross-slide 42 is caused to advance the winding becomes rough. The speed of the cross-slide 42 determines the winding pitch of the coil, and it can be controlled by the variable change gear 84 and the speed reducer 82.

When the cross-slide 42 comes into abutment with the switch 9*b*, whose position is previously determined in accordance with the desired length of the coil, the switch is turned on to disconnect the clutch 81, thereby stopping the movement of the cross-slide. But the motor 1 does not stop because of the operation of a time switch (not shown), and continues its rotation for a predetermined period of time, during which the terminal close winding is performed while the cross-slide 42 is further advanced to the right. After the predetermined period of time expires the winding operation comes to a stop, and the finished coil is removed from the coil-supporter.

When the pedal switch 'SW' is again actuated the motor 85 is reversely rotated, and the clutch 81 is connected, thereby causing the threaded bar 72 to rotate reversely. In this way the cross-slide 42 is returned to its starting position until it comes into engagement with the switch 9*a*, whereby the motor 85 is stopped and the clutch is disconnected. A cycle of operation is thus finished.

Instead of employing the pedal switch a time switch can be used to ensure a completely automatic operation of the apparatus.

In a further preferred embodiment the cross-slide and the nut can be constructed so as to move simultaneously without the use of the bolts 5*a* and 5*b*, wherein the nut, preferably a half-nut, is arranged so as to be connected with and disconnected from the threaded bar.

In inserting the end of a material wire (A) in the fastening gap 2b it is desired that the spindle 1a including the coil-supporter 3 should take a constant position, and the brake-motor referred to above is aimed at achieving this convenience. For example, a position indicating member can be provided in the chuck, or a chuck pawl can be selected for the indicator, and a detector of the position indicator can be provided, so as to control the motor 1 in response to the position of the indicator. The detector can be a photo-transistor, a non-contact or contact switch.

I claim:

1. Apparatus for producing a coiled spring comprising:

(a) a rotatable coil supporter and means for rotating said coil supporter;

(b) means for supplying wire to said coil supporter including wire guiding means;

(c) said coil supporter including wire catching means for catching wire supplied to it;

(d) said wire guiding means being carried on an assembly movable along the axis of said coil supporter, movement of said assembly moving the position at which wire is supplied to said coil supporter;

(e) means for moving said assembly, said means including drive means which rotates a screw which is in engagement with a nut;

(f) said screw being rotatable independently of said means for rotating said coil supporter;

(g) opposed ends of said assembly being spaced along the axis of said screw and being engageable for movement by said nut;

(h) said nut being spaced from one said end whereby initial rotation of said screw will drive said nut without resulting in movement of said assembly;

(i) continued driving of said nut by said screw resulting in movement of said assembly with respect to the axis of said coil supporter; and (j) a limit switch effective to stop rotation of said screw after a predetermined travel of said assembly.

2. An apparatus of producing a coiled spring as claimed in claim 1, wherein the coil-supporter includes a driving motor, a spindle, a chuck, and a shaft fixed to said chuck, and wherein the wire catching means is provided in said chuck.

3. The apparatus of claim 1 wherein the spacing between said one said end and said nut is adjustable.

4. The apparatus of claim 1 wherein the drive means is variable in speed.

5. The apparatus of claim 1 wherein the drive means is reversible.

* * * * *